US008189823B2

(12) United States Patent
Tezuka et al.

(10) Patent No.: US 8,189,823 B2
(45) Date of Patent: May 29, 2012

(54) SPEAKER SYSTEM

(75) Inventors: Seiichi Tezuka, Kobe (JP); Tsutomu Yoshioka, Kobe (JP)

(73) Assignee: Toa Corporation, Kobe-shi (JP)

( * ) Notice: Subject to any disclaimer, the term of this patent is extended or adjusted under 35 U.S.C. 154(b) by 457 days.

(21) Appl. No.: 12/514,569

(22) PCT Filed: Nov. 12, 2007

(86) PCT No.: PCT/JP2007/071943

§ 371 (c)(1),
(2), (4) Date: Sep. 9, 2009

(87) PCT Pub. No.: WO2008/059802

PCT Pub. Date: May 22, 2008

(65) Prior Publication Data

US 2010/0027827 A1 Feb. 4, 2010

(30) Foreign Application Priority Data

Nov. 14, 2006 (JP) ..... 2006-308086

(51) Int. Cl.
*H04R 25/00* (2006.01)

(52) U.S. Cl. ..... 381/182; 381/386

(58) Field of Classification Search ..... 381/300, 381/308, 182, 386, 387, 394–395
See application file for complete search history.

(56) References Cited

U.S. PATENT DOCUMENTS

| | | | | |
|---|---|---|---|---|
| 4,006,311 A | | 2/1977 | Carlsson | |
| 4,221,929 A | * | 9/1980 | Fukuda | 381/182 |
| 4,227,051 A | | 10/1980 | Thomas et al. | |
| 5,548,657 A | | 8/1996 | Fincham | |
| 7,302,061 B2 | * | 11/2007 | Rivera | 381/386 |
| 2003/0142844 A1 | | 7/2003 | Rivera | |
| 2004/0240697 A1 | | 12/2004 | Keele | |

FOREIGN PATENT DOCUMENTS

| | | |
|---|---|---|
| JP | 61-187195 | 11/1986 |
| JP | 5-65194 | 8/1993 |
| JP | 2004-023148 | 1/2004 |
| JP | 2004-165917 | 6/2004 |
| WO | WO-98/07297 | 2/1998 |

OTHER PUBLICATIONS

Extended European Search Report issued in DE 07831673.4-2225 (PCT/JP2007/071943) on Mar. 31, 2011.

International Search Report from corresponding PCT/JP2007/071943 dated Jan. 22, 2008.

European Patent Office Communication dated Dec. 27, 2011 in corresponding application nr. 07 831 673.4.

* cited by examiner

*Primary Examiner* — Suhan Ni

(74) *Attorney, Agent, or Firm* — Marshall, Gerstein & Borun LLP

(57) ABSTRACT

An object of the present invention is to provide a speaker system in which a woofer and a group of tweeters are substantially coaxially arranged, and sound waves emitted from the woofer and sound waves emitted from the tweeter are less likely to interfere with each other in at least one direction, and whose sound pressure frequency characteristics easily stabilize. A speaker system according to the present invention includes a woofer and three or more tweeters, and the tweeters are arranged in front of the woofer in a circular-arc formation.

8 Claims, 7 Drawing Sheets

SPEAKER SYSTEM

TECHNICAL FIELD

The present invention relates to a speaker system, and particularly to a speaker system in which a woofer and a group of tweeters are substantially coaxially arranged.

BACKGROUND ART

To improve sound quality, many speakers adopt a 2-way system in which sound waves in a low-pitched sound range are emitted from a woofer and sound waves in a high-pitched sound range are emitted from a tweeter. In a common 2-way speaker system, the tweeter and the woofer are arranged in a vertical direction or a horizontal direction. Therefore, the common 2-way speaker system needs to have a wider area on a front surface (baffle plate) thereof than a single-cone speaker having one cone.

Here, proposed is a speaker system in which the tweeter and the woofer are arranged in a front-back direction. In many of such speaker systems, the tweeter and the woofer are coaxially arranged, and such speaker system is called "coaxial speaker" (see Patent Document 1 for example). In a common coaxial speaker, the tweeter is smaller than the woofer, and is arranged in front of the woofer or inside a cone of the woofer. Therefore, the area of the front surface of the speaker system can be reduced, so that the speaker system can be reduced in size.

Patent Document 1: Japanese Laid-Open Patent Application Publication 2004-165917

DISCLOSURE OF THE INVENTION

Problems to be Solved by the Invention

FIG. 8 schematically show vertical cross sections of a common coaxial speaker 21. As shown in FIG. 8, in the common coaxial speaker 21, a tweeter 23 is arranged in front of a bottom portion of a woofer 22, and the area of an opening of the tweeter 23 is much smaller than the area of an opening of the woofer 22. FIG. 8(*a*) is a diagram showing the propagation of sound waves emitted from the tweeter 23. FIG. 8(*b*) is a diagram showing the propagation of sound waves emitted from the woofer 22.

As described above, the 2-way speaker system emits the sound waves in the low-pitched sound range from the woofer and emits the sound waves in the high-pitched sound range from the tweeter. However, there is a frequency range of sound waves which are emitted from both the woofer and the tweeter. To be specific, such frequency range is a frequency range including a crossover frequency and frequencies in the vicinity of the crossover frequency. FIG. 8(*c*) is a diagram showing that the sound waves emitted from the woofer 22 and the sound waves emitted from the tweeter 23 overlap each other at the crossover frequency, and shows a state where the phase of the sound wave emitted from the woofer 22 and the phase of the sound wave emitted from the tweeter 23 overlap each other in a front direction. As shown in FIG. 8(*c*), since, for example, the opening of the cone of the woofer 22 and the opening of the cone of the tweeter 23 are different in size from each other, a center position of a circular arc of the spreading sound wave emitted from the woofer 22 and a center position of a circular arc of the spreading sound wave emitted from the tweeter 23 are different from each other. Therefore, the sound wave emitted from the woofer 22 and the sound wave emitted from the tweeter 23 overlap each other in the front direction of the coaxial speaker 21, but the phase of the sound wave emitted from the woofer 22 and the phase of the sound wave emitted from the tweeter 23 do not overlap each other in directions except for the front direction. Therefore, in some directions except for the front direction, both of these sound waves shift each other by a half wavelength, interfere with each other, and cancel each other. Therefore, a polar pattern of such frequency is not smooth.

FIG. 8(*d*) is a diagram showing that a range (range in which a sound of a certain sound pressure level can be heard) of a directivity angle of the woofer 22 and a range of a directivity angle of the tweeter 23 overlap each other. As shown in FIG. 8(*d*), since the directivity angle of the tweeter 23 is commonly larger than the directivity angle of the woofer 22, sound pressure frequency characteristics significantly change depending on the directions. However, in some use conditions, it may be enough to emit stable sound waves in one direction, such as a vertical direction or a horizontal direction.

Here, an object of the present invention is to provide a speaker system in which a woofer and a group of tweeters are coaxially arranged, and the sound waves emitted from the woofer and the sound waves emitted from the tweeter are less likely to interfere with each other in at least one direction, and whose sound pressure frequency characteristics easily stabilize in at least one direction.

Means for Solving the Problems

To solve the above problems, a speaker system of the present invention includes: a woofer; and three or more tweeters, wherein the tweeters are arranged in front of the woofer in a circular-arc formation which is convex toward a direction in which the woofer emits sound.

With this configuration, since the tweeters are arranged in a line, the group of three or more tweeters serves as one sound source by a line array effect, and can be regarded as one speaker having a large opening. In addition, the center position of the sound wave spreading in a circular-arc shape from the tweeters can be made closer to the center position of the sound wave spreading in a circular-arc shape from the woofer. Further, the directivity angle of the group of the tweeters becomes small by the line array effect. However, since the tweeters are arranged in a circular-arc formation, the directivity angle of the group of the tweeters can be made closer to the directivity angle of the woofer. Here, the line array effect means that by arranging a plurality of speakers in a line, sound sources from the speakers become a single sound source and a line sound source, and the sound wave is transmitted in a line. By using this effect, the speaker system can efficiently emit the sound whose energy is less likely to attenuate as compared to a single speaker that is a point sound source and emits the sound spreading in a spherical shape.

Moreover, in the speaker system, in a flat plane including axes of two tweeters arranged on both ends among the three or more tweeters, a directivity angle of the group of the three or more tweeters at a crossover frequency may be substantially the same as a directivity angle of the woofer at the crossover frequency. With this configuration, the directivity angle of the group of the tweeters and the directivity angle of the woofer are substantially the same as each other at the crossover frequency. Therefore, the directivity angle does not significantly change when the output of the speaker system changes from the woofer to the tweeters. On this account, the sound pressure frequency characteristics easily stabilize even in the vicinity of the crossover frequency.

Moreover, in the speaker system, the directivity angle of the group of the three or more tweeters at the crossover frequency may be 90% to 110% of the directivity angle of the woofer at the crossover frequency. If the directivity angle is within this range, the above effect at the crossover frequency can be adequately obtained.

Moreover, in the speaker system, an axis of the tweeter located on a more outer side among the three or more tweeters may incline more outwardly. With this configuration, the axis of the tweeter located on a more outer side inclines in a fan-like form as with the propagation of the sound wave. Therefore, the tweeters can emit the sound wave whose propagation is similar to the propagation of the sound wave of the woofer.

Moreover, in the speaker system, an angle between the axes of two tweeters located on both ends among the three or more tweeters may be 70% to 90% of the directivity angle of the woofer at the crossover frequency. Even if the angle between two tweeters arranged on both ends among three or more tweeters is adjusted to be the same as the directivity angle of the woofer at the crossover frequency, the directivity angles of the woofer and the group of the tweeters do not coincide with each other at the crossover frequency. In contrast, with the above configuration, the directivity angle of the group of three or more tweeters at the crossover frequency can be set to be substantially the same as the directivity angle of the woofer at the crossover frequency.

Moreover, the speaker system may further include a tweeter frame hanged between two opposed positions located in the vicinity of a peripheral edge of the woofer, wherein: the three or more tweeters may be attached to the tweeter frame; and the tweeter frame may have a flare-shape side wall to serve as a constant directivity horn. With this configuration, by the effect of the constant directivity horn, the directivity angle in a direction perpendicular to the direction in which the tweeters are arranged can be adjusted.

Moreover, the speaker system may further include a rear cover covering rear portions of the three or more tweeters, wherein in a state where the rear cover is attached to the tweeters, the rear cover may have a mountain-like shape whose sharp angle faces the woofer. With this configuration, it is possible to prevent the sound wave emitted from the woofer from reflecting on rear portions of the tweeters.

Moreover, the speaker system may further include an enclosure to which the woofer is attached, wherein: the enclosure may have an inclined surface on a rear side thereof; and in a case where the enclosure is placed on a horizontal surface by using the inclined surface as a bottom surface, the axis of the woofer may extend diagonally upwardly, and the three or more tweeters may be arranged in a horizontal direction. With this configuration, in a case where, for example, the speaker system is placed on a floor, and the range of emission of the sound wave in the horizontal direction may be narrow, the speaker system can efficiently emit the sound wave whose energy is less likely to attenuate in this range.

Effects of the Invention

In accordance with the present invention, in a flat plane including axes of two tweeters arranged on both ends among three or more tweeter, a center position of a sound wave spreading in a circular-arc shape from the tweeters can be made closer to a center position of a sound wave spreading in a circular arc shape from the woofer. In addition, the directivity angle of the group of the tweeters can be made closer to the directivity angle of the woofer. With this, the present invention can provide a speaker system in which the woofer and the group of the tweeters are coaxially arranged, the sound waves emitted from the woofer and the sound waves emitted from the tweeter are less likely to interfere with each other in at least one direction, and whose sound pressure frequency characteristics easily stabilize.

BRIEF DESCRIPTION OF THE DRAWINGS

FIG. 5(*a*) is a front view, FIG. 5(*b*) is a top view, and FIG. 5(*c*) is a right side view.

BEST MODE FOR CARRYING OUT THE INVENTION

Hereinafter, a best mode for carrying out a speaker system 1 of the present invention will be explained in reference to FIGS. 1 to 7.

Figure 1:
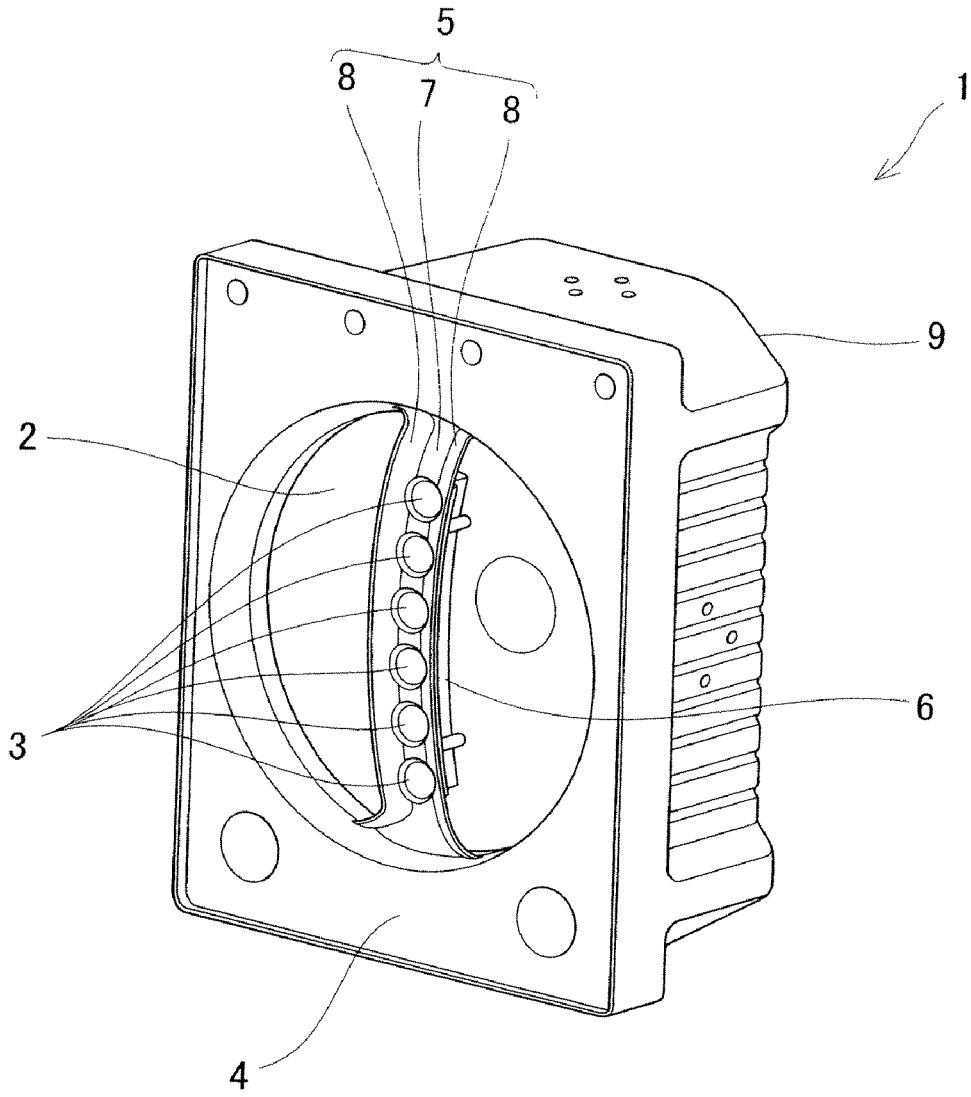
FIG. 1 is a perspective view of a speaker system according to the present invention.

FIG. 1 is a perspective view of the speaker system 1 according to the present embodiment. As shown in FIG. 1, the speaker system 1 includes a woofer 2, tweeters 3, an enclosure 4, a tweeter frame 5, and a rear cover 6. The present embodiment adopts a 2-way system.

Figure 2:
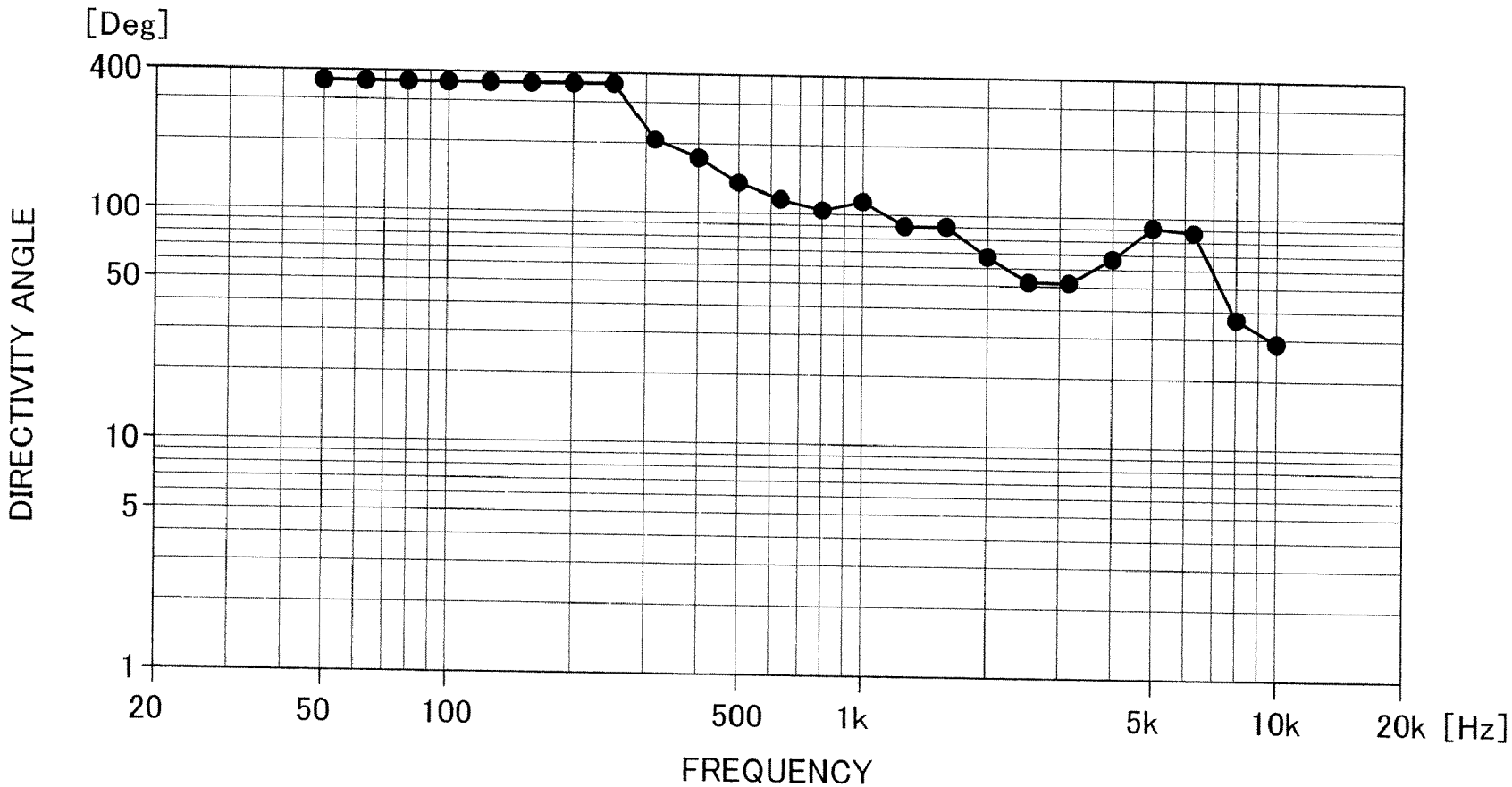
FIG. 2 is a graph showing a relation between the directivity angle and frequency of a woofer of FIG. 1.

The woofer 2 is a cone speaker, and serves to emit sound waves in a low-pitched sound range. As shown in FIG. 1, the woofer 2 is attached to the center of a front surface (baffle plate) of the enclosure 4. In the present embodiment, the woofer 2 has a diameter of about 30 cm. FIG. 2 is a graph showing the relation between the directivity angle and frequency of the woofer 2 according to the present embodiment. In FIG. 2, a horizontal axis denotes the frequency, and a vertical axis denotes the directivity angle. As shown in FIG. 2, the directivity angle gradually decreases from about 250 Hz of the frequency of the woofer 2. Thus, the directivity angle of the woofer 2 tends to decrease as the frequency of the woofer 2 increases.

The tweeter 3 is a cone speaker, and serves to emit sound waves in a high-pitched sound range. As shown in FIG. 1, the speaker system 1 according to the present embodiment includes six tweeters 3, and all the tweeters 3 are attached to the tweeter frame 5. In the present embodiment, each tweeter 3 has a diameter of about 3.5 cm. Moreover, six tweeters 3 are arranged in front of the woofer 2 in a line and a circular-arc formation. By a line array effect realized by arranging six tweeters 3 in a line, each tweeter 3 does not emit the sound wave spreading in a spherical shape, but the group of six tweeters 3 transmits a linear sound wave. With this, a portion emitting a sound source can be regarded as one large sound source, and the center position of the sound wave spreading in a circular-arc shape from the group of the tweeters 3 can be moved backward. To be specific, the center position of the sound wave spreading in the circular-arc shape from the group of the tweeters 3 and the center position of the sound wave spreading in the circular-arc shape from the woofer 2 can be made closer to each other. With this, for example, by adjusting the phase of the sound wave emitted from the woofer 2 and the phase of the sound wave emitted from the tweeter 3 to coincide with each other at the front of the speaker system 1, the sound wave emitted from the tweeter 3 and the sound wave emitted from the woofer 2 are less likely to interfere with each other not only in the front direction but also the directions except for the front direction in a flat plane including axes of two tweeter 3 arranged on both ends. Further, by changing a curvature radius of the circular arc on which the tweeters 3 are arranged, the directivity angle of the group of the tweeters 3 can be adjusted. With this, by setting the directivity angle of the group of the tweeters 3 to be the same as the directivity angle of the woofer 2, the sound pressure frequency characteristics easily stabilizes. The axis of the tweeter 3 located on a more outer side among six tweeters 3 inclines more outwardly. In the present embodiment, an angle between the axes of two tweeters 3 located on both ends among six tweeters 3 is 40 degrees.

Figure 3:
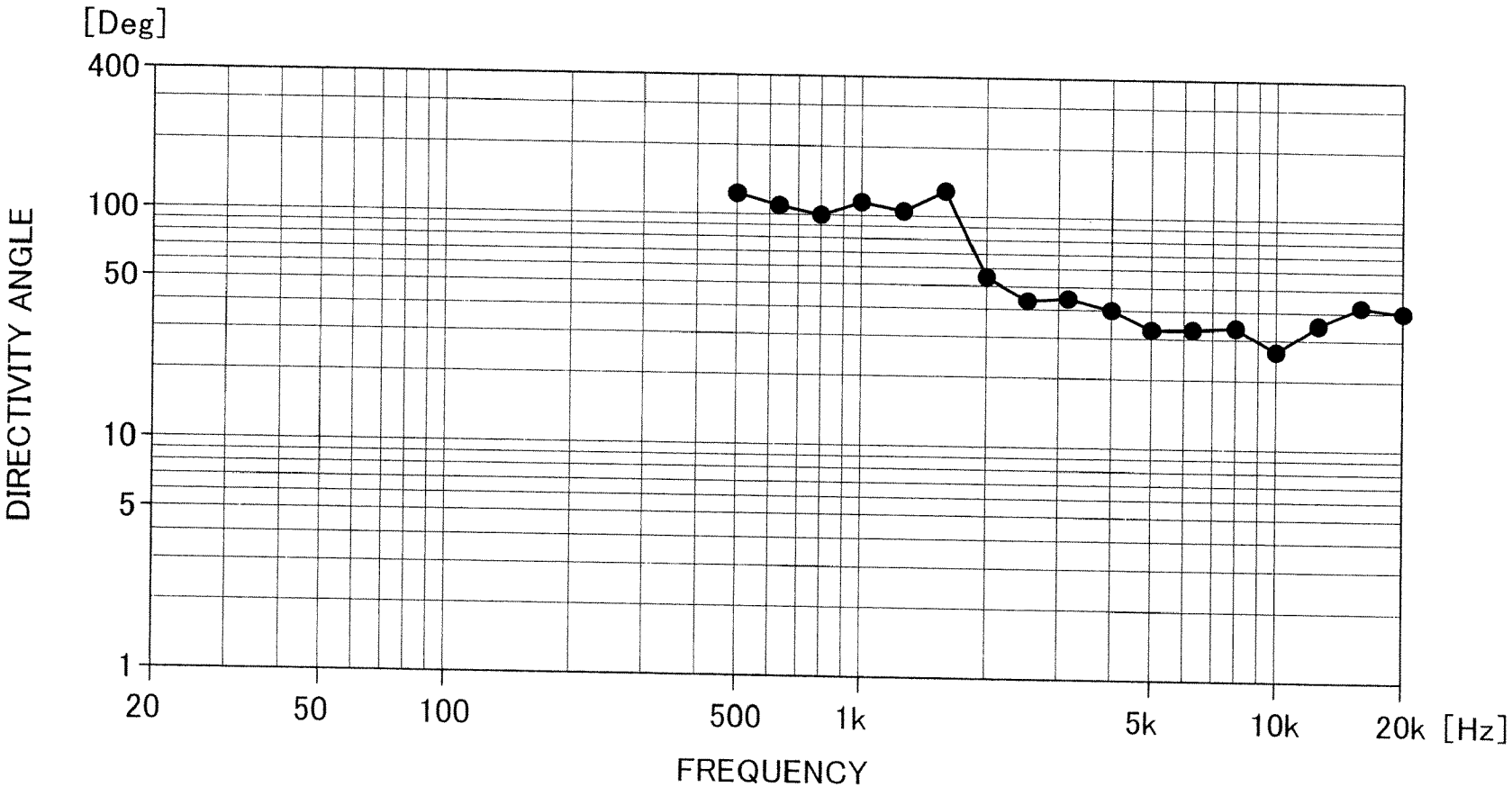
FIG. 3 is a graph showing a relation between the directivity angle and frequency of a tweeter of FIG. 1.

FIG. 3 is a graph showing a relation between the directivity angle and frequency of the tweeter 3 according to the present embodiment. In FIG. 3, a horizontal axis denotes the frequency, and a vertical axis denotes the directivity angle. Moreover, the value of the directivity angle is a value in the flat plane including the axes of two tweeters 3 arranged on both ends. As shown in FIG. 3, as with the woofer 2, the directivity angle of the tweeter 3 tends to decrease as the frequency increases.

Figure 4:
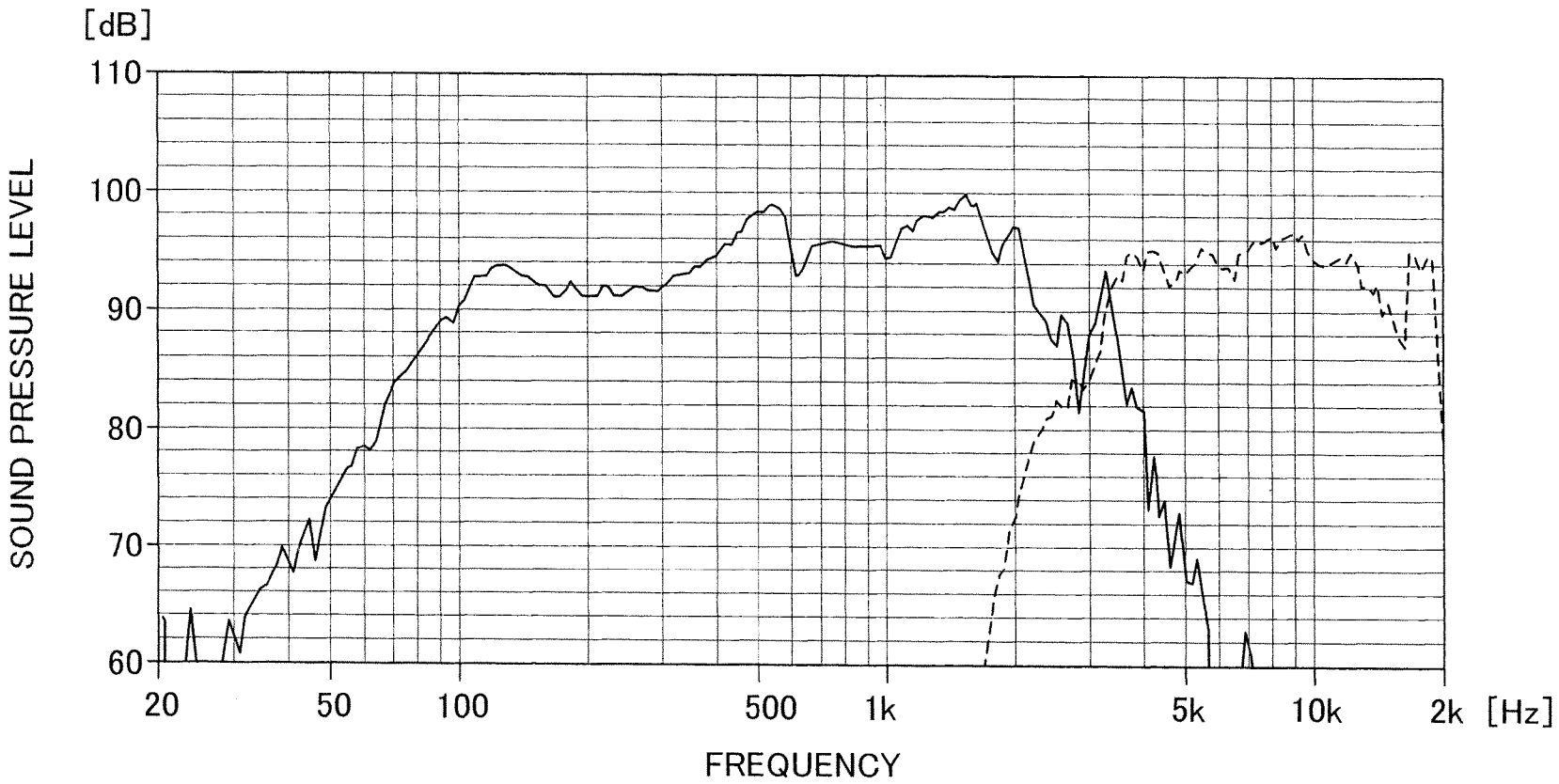
FIG. 4 is a graph showing a relation between the frequency and sound pressure level of the woofer of FIG. 1 and a relation between the frequency and sound pressure level of the tweeter of FIG. 1.

FIG. 4 is a graph showing a relation between the frequency and sound pressure level of the tweeter 3 and a relation between the frequency and sound pressure level of the woofer 2. In FIG. 4, a horizontal axis denotes the frequency, and a vertical axis denotes the sound pressure level. Moreover, a solid line denotes the woofer 2, and a broken line denotes the tweeter 3. As shown in FIG. 4, a curved line of the woofer 2 and a curved line of the tweeter 3 intersect with each other in the vicinity of the frequency of 3 kHz. That is, the vicinity of 3 kHz is a crossover frequency. Note that a sound signal from an audio device or the like is transmitted via a dividing network to the woofer and the tweeter. The crossover frequency is set in the dividing network.

Referring again to FIGS. 2 and 3, in the vicinity of the frequency of 3 kHz, each of the directivity angle of the woofer 2 and the directivity angle of the tweeter 3 is about 50 degrees. As above, in the present embodiment, inclination angles of the axes of six tweeters 3 are set such that the directivity angle of the group of the tweeters 3 is substantially the same as the directivity angle of the woofer 2. By setting the directivity angle as above, the directivity angle does not significantly change when changing from the frequency range of the sound wave mainly emitted from the woofer 2 to the frequency range of the sound wave mainly emitted from the tweeter 3 or when changing conversely. Therefore, even in the vicinity of the crossover frequency, the sound pressure frequency characteristics easily stabilize.

The directivity angle of the group of six tweeters 3 does not have to coincide with the directivity angle of the woofer 2 at the crossover frequency. To be specific, the above effects can be adequately obtained as long as the directivity angle of the group of six tweeters 3 is in a range from 90% to 110% of the directivity angle of the woofer 2 at the crossover frequency. Such setting of the directivity angle can be realized by setting the angle between the axes of two tweeters 3 arranged on both ends to be in a range from 70% to 90% of the directivity angle of the woofer 2 at the crossover frequency. In the present embodiment, the above setting is realized by setting the angle between the axes of two tweeters 3 arranged on both ends to be 40 degrees, i.e., 80% of 50 degrees which is the directivity angle of the woofer 2 at the crossover frequency.

Figure 5A:
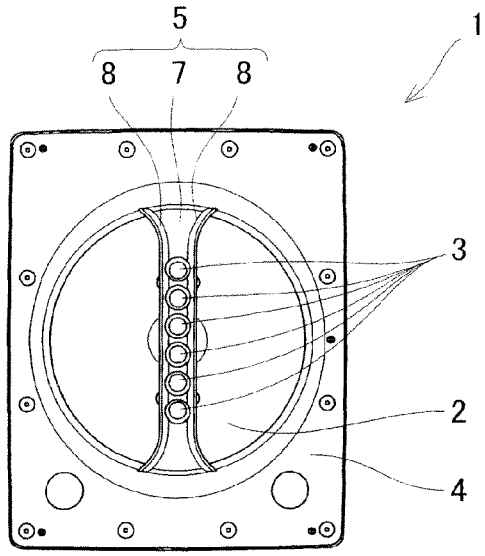
FIG. 5 are diagrams showing an enclosure of FIG. 1.
Figure 5B:
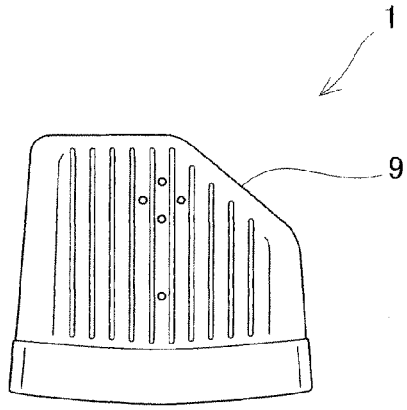
Figure 5C:
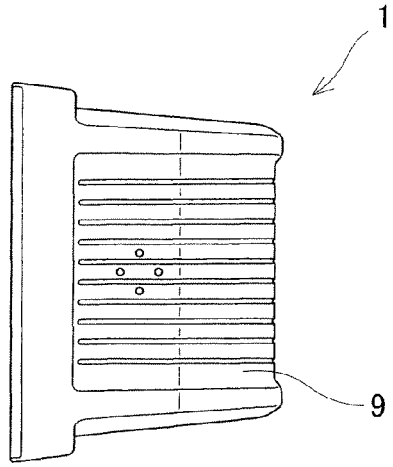
Figure 6:
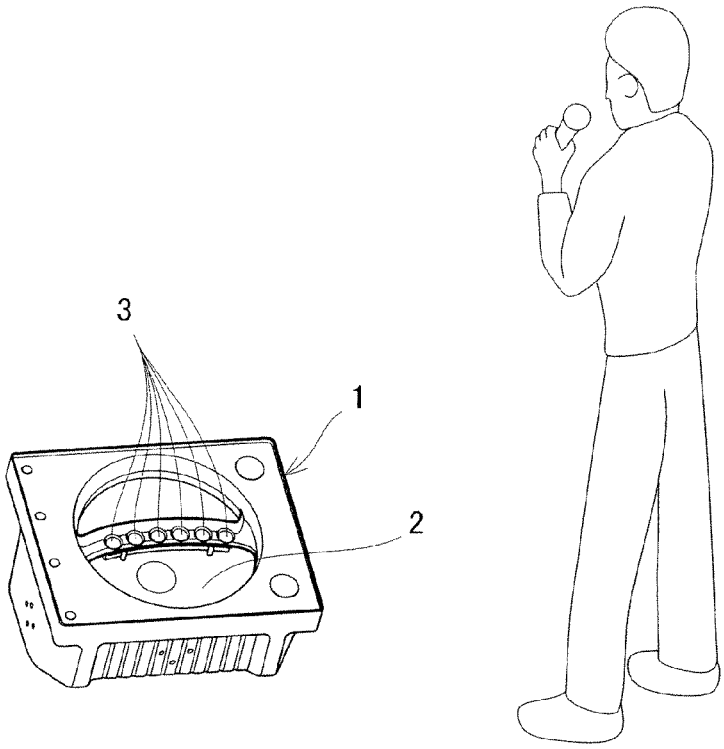
FIG. 6 is a diagram showing one example of use of the speaker system according to the present invention.

The enclosure 4 serves to fix the tweeter frame 5 to which the woofer 2 and the tweeter 3 are mainly attached. FIG. 5 are diagrams showing the enclosure 4. FIG. 5(*a*) is a front view, FIG. 5(*b*) is a top view, and FIG. 5(*c*) is a right side view. As shown in FIG. 5, the enclosure 4 includes an inclined surface 9 on a rear side thereof. When the enclosure 4 is placed on a horizontal surface by using the inclined surface 9 as a bottom surface, the axis of the woofer 2 extends diagonally upwardly, and six tweeters 3 are arranged in a horizontal direction. When the enclosure 4 is placed on the horizontal surface by using the inclined surface 9 as the bottom surface, the range in the horizontal direction is limited due to the shape of the enclosure 4, but the sound wave can be stably emitted within this range. For example, as shown in FIG. 6, the speaker system 1 can efficiently emit the sound wave when, for example, it is used as a front monitor for a MC (Master of Ceremonies). To be specific, since the MC often moves forward and backward but does not often move rightward and leftward, problems do not occur even if the directivity angle in the horizontal direction is small. In fact, since the speaker system emits the sound wave which is less likely to attenuate in this region, it is extremely effective.

The tweeter frame 5 serves to fix the tweeters 3. As shown in FIG. 1, the tweeter frame 5 is joined to the enclosure 4 in the vicinity of a peripheral edge of the woofer 2. Moreover, the joined portions are upper and lower positions of the woofer 2. To be specific, the tweeter frame 5 is hanged between two opposed positions located in the vicinity of the peripheral edge of the woofer 2.

The tweeter frame 5 is mainly constituted by a base portion 7 and side walls 8. The tweeters 3 are attached to the base portion 7. The width of the base portion 7 is substantially the same as the diameter of the opening of the tweeter 3, but both end portions connected to the enclosure 4 are wider to increase the strength. Moreover, the base portion 7 has a circular-arc shape, and the center position of this circular arc is substantially the same as the center position of the sound wave spreading in the circular-arc shape from the woofer 2. Moreover, the axis of the tweeter 3 intersects with the base portion 7 at right angle. With this configuration, the tweeter 3 can emit the sound wave along the propagation of the sound wave emitted from the woofer 2.

The side wall 8 has a flare shape extending along a side end portion of the base portion 7 and spreading outwardly. With this, the tweeter frame 5 can serve as a constant directivity horn. Therefore, the directivity can be controlled in not only a direction in which the tweeters 3 are arranged but also a direction perpendicular to the direction in which the tweeters 3 are arranged. Thus, the sound wave can be efficiently emitted. Note that the base portion 7 and the side wall 8 are substantially the same in thickness as each other, and the thickness is about 7 mm.

Figure 7:
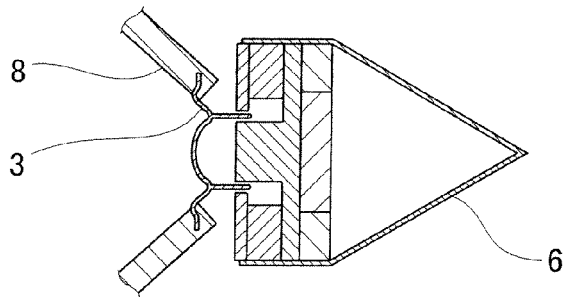
FIG. 7 is a horizontal cross-sectional view of the tweeter to which a rear cover of FIG. 1 is attached.
Figure 8A:
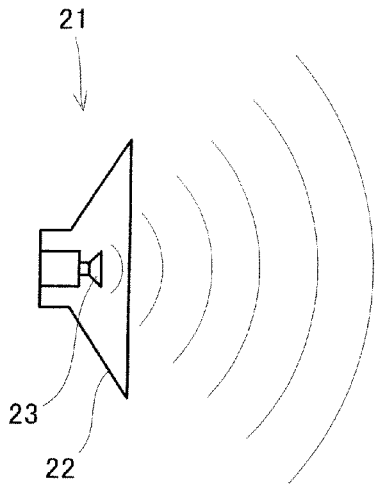
FIG. 8 is a schematic cross-sectional view of a conventional speaker system in which the woofer and the tweeter are coaxially arranged.
Figure 8B:
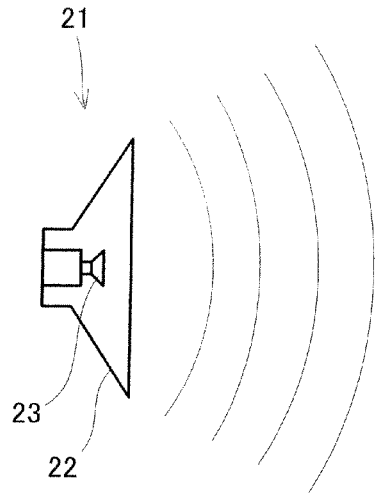
Figure 8C:
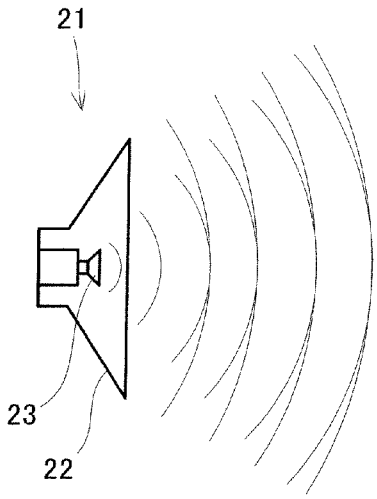
Figure 8D:
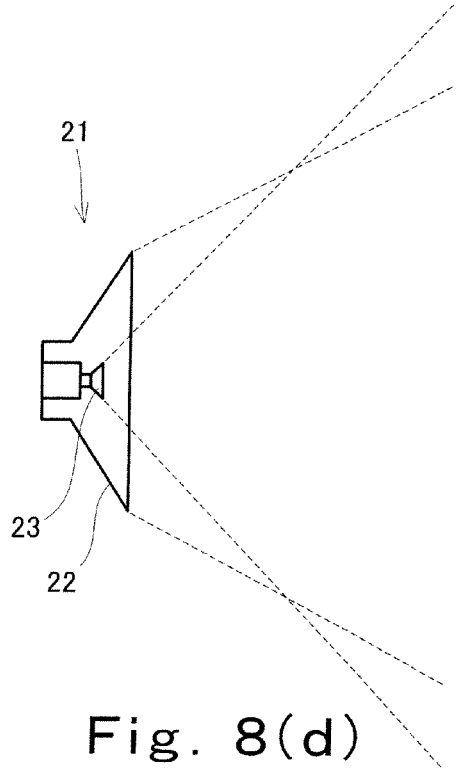

The rear cover 6 is a member covering rear portions of the tweeters 3. Moreover, the rear cover 6 is attached to the tweeter frame 5 by screws so as to sandwich the tweeters 3. FIG. 7 is a horizontal cross-sectional view of the tweeter 3 to which the rear cover 6 is attached. As shown in FIG. 7, the rear cover 6 has a mountain-like shape whose sharp angle faces the woofer 2. Thus, by covering the rear portions of the tweeters 3 with the rear cover 6 having the mountain-like shape, the sound wave emitted from the woofer 2 is less likely to reflect on the rear portions of the tweeters 3. Therefore, it is possible to suppress interference between the sound wave directly emitted from the woofer 2 and the reflected sound wave.

The foregoing has explained the configuration of the speaker system 1 according to the present embodiment. In a case where the common 2-way speaker system (system in which the woofer and the tweeter are not coaxially arranged) emits sound for listeners near the system, the listeners often recognize that the positions of the sound sources, such as the tweeter and the woofer, are different from each other, and the sound is unnatural. In contrast, even in a case where 2-way and 3-way speaker systems using a coaxial system emit sound for listeners near the system, the above unnatural sound is not emitted. Further, the 2-way speaker system in which the woofer and the group of three or more tweeters are coaxially arranged as in the present invention has an advantage that the sound emitted for the listeners near the system is not unnatural, and in addition, it can emit the sound for only a specific listener by controlling the directivity. Therefore, the present invention can realize a speaker system especially suitable for the application shown in FIG. 6.

From the foregoing explanation, many modifications and other embodiments of the present invention are obvious to one skilled in the art. Therefore, the foregoing explanation should be interpreted only as an example, and is provided for the purpose of teaching the best mode for carrying out the present invention to one skilled in the art. The structures and/or functional details may be substantially modified within the spirit of the present invention.

INDUSTRIAL APPLICABILITY

The present invention can provide a speaker system in which the woofer and the group of the tweeters are coaxially arranged, and the sound waves emitted from the woofer and the sound waves emitted from the tweeter are less likely to interfere with each other in at least one direction, and whose sound pressure frequency characteristics easily stabilize in at least one direction. Therefore, the present invention is useful in the technical field of the speaker system, especially in the technical field of the speaker system in which the woofer and the group of the tweeters are coaxially arranged.

The invention claimed is:

1. A speaker system comprising:

a woofer; and three or more tweeters, wherein the tweeters are arranged in front of the woofer in a circular-arc formation which is convex toward a direction in which the woofer emits sound.

2. The speaker system according to claim 1, wherein in a flat plane including axes of two tweeters arranged on both ends among the three or more tweeters, a directivity angle of the group of the three or more tweeters at a crossover frequency is substantially the same as a directivity angle of the woofer at the crossover frequency.

3. The speaker system according to claim 2, wherein the directivity angle of the group of the three or more tweeters at the crossover frequency is 90% to 110% of the directivity angle of the woofer at the crossover frequency.

4. The speaker system according to claim 1, wherein an axis of the tweeter located on a more outer side among the three or more tweeters inclines more outwardly.

5. The speaker system according to claim 4, wherein an angle between the axes of two tweeters located on both ends among the three or more tweeters is 70% to 90% of the directivity angle of the woofer at the crossover frequency.

6. The speaker system according to claim 1, further comprising a tweeter frame hanged between two opposed positions located in the vicinity of a peripheral edge of the woofer, wherein:

the three or more tweeters are attached to the tweeter frame; and the tweeter frame has a flare-shape side wall to serve as a constant directivity horn.

7. The speaker system according to claim 1, further comprising a rear cover covering rear portions of the three or more tweeters, wherein in a state where the rear cover is attached to the tweeters, the rear cover has a mountain-like shape whose sharp angle faces the woofer.

8. The speaker system according to claim 1, further comprising an enclosure to which the woofer is attached, wherein:

the enclosure has an inclined surface on a rear side thereof; and in a case where the enclosure is placed on a horizontal surface by using the inclined surface as a bottom surface, the axis of the woofer extends diagonally upwardly, and the three or more tweeters are arranged in a horizontal direction.

* * * * *